US006786274B2

(12) United States Patent
Bemisderfer

(10) Patent No.: US 6,786,274 B2
(45) Date of Patent: Sep. 7, 2004

(54) HEAT EXCHANGER FIN HAVING CANTED LANCES

(75) Inventor: Charles H. Bemisderfer, Red Lion, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/241,487

(22) Filed: Sep. 12, 2002

(65) Prior Publication Data

US 2004/0050539 A1 Mar. 18, 2004

(51) Int. Cl.[7] ..... F28D 1/04
(52) U.S. Cl. ..... 165/151; 165/181
(58) Field of Search ..... 165/151, 152, 165/181, 182

(56) References Cited

U.S. PATENT DOCUMENTS

| | | | | |
|---|---|---|---|---|
| 1,416,570 A | | 5/1922 | Modine | |
| 2,079,032 A | | 5/1937 | Optiz | |
| 3,003,749 A | | 10/1961 | Morse | |
| 3,741,285 A | | 6/1973 | Kuethe | |
| 4,300,629 A | * | 11/1981 | Hatada et al. | 165/151 |
| 4,328,861 A | | 5/1982 | Cheong et al. | |
| 4,469,167 A | | 9/1984 | Itoh et al. | |
| 4,676,304 A | | 6/1987 | Koisuka et al. | |
| 4,691,767 A | | 9/1987 | Tanaka et al. | |
| 4,691,768 A | * | 9/1987 | Obosu | 165/151 |
| 4,705,105 A | * | 11/1987 | Cur | 165/151 |
| 4,723,599 A | | 2/1988 | Hanson | |
| 4,787,442 A | * | 11/1988 | Esformes | 165/151 |
| 5,062,475 A | | 11/1991 | Bemisderfer et al. | |
| 5,168,923 A | | 12/1992 | Sacks | |
| 5,209,289 A | | 5/1993 | Haushalter | |
| 5,353,866 A | | 10/1994 | Ueda et al. | |
| 5,360,060 A | * | 11/1994 | Tanaka et al. | 165/151 |
| 5,501,270 A | | 3/1996 | Young et al. | |
| 5,553,663 A | | 9/1996 | Yu | |
| 5,611,395 A | | 3/1997 | Kang et al. | |
| 5,705,105 A | | 1/1998 | Inoue | |
| 5,722,485 A | | 3/1998 | Love et al. | |
| 5,738,168 A | | 4/1998 | Patel et al. | |
| 5,755,281 A | | 5/1998 | Kang et al. | |
| 5,848,638 A | | 12/1998 | Kim | |
| 5,887,649 A | | 3/1999 | Kim | |

FOREIGN PATENT DOCUMENTS

| | | |
|---|---|---|
| EP | 0 430 852 A1 | 6/1991 |
| GB | 2 027 533 A | 2/1980 |
| JP | 59-189292 | 10/1984 |
| JP | 59-189293 | 10/1984 |

* cited by examiner

*Primary Examiner*—Terrell McKinnon
(74) *Attorney, Agent, or Firm*—Finnegan, Henderson, Farabow, Garrett & Dunner, L.L.P.

(57) ABSTRACT

A heat exchanger coil assembly is provided. The fins of the assembly include lance style enhancements on a corrugated shape of the fin. Lances are provided on both the upstream and the downstream sides of each corrugation. The upstream lance forms a first angle with respect to a direction of mean airflow and the downstream lance forms a second angle with respect to the direction of mean airflow. The first and second angles are not equal, such that the lances are canted with respect to one another. This generates two different streams of air flow such that a wake of the upstream lance will not impinge on the downstream lance, thereby maximizing heat transfer for both the upstream and the downstream lances.

23 Claims, 6 Drawing Sheets

HEAT EXCHANGER FIN HAVING CANTED LANCES

FIELD OF THE INVENTION

This invention relates to an apparatus and method for maximizing heat transfer in both upstream and downstream fin enhancements of a heat exchanger fin.

BACKGROUND OF THE INVENTION

Finned heat exchanger coil assemblies are widely used in a number of applications in fields such as air conditioning and refrigeration. A finned heat exchanger coil assembly generally includes a plurality of spaced parallel tubes through which a heat transfer fluid such as water or refrigerant flows. A second heat transfer fluid, usually air, is directed across the tubes. A plurality of fins is usually employed to improve the heat transfer capabilities of the heat exchanger coil assembly. Each fin is a thin metal plate, made of copper or aluminum, which may or may not include a hydrophilic coating. Each fin includes a plurality of apertures for receiving the spaced parallel tubes, such that the tubes generally pass through the plurality of fins at right angles to the fins. The fins are arranged in a parallel, closely-spaced relationship along the tubes to form multiple paths for the air or other heat transfer fluid to flow across the fins and around the tubes.

Often the fin includes one or more enhancements to improve the efficiency of heat transfer. For example, many prior art heat exchanger fins include a smooth enhancement, such as a corrugated or sinusoid-like shape when viewed in cross-section. In addition, or instead of, the smooth enhancement, heat exchanger fins may also include enhancements such as lances or louvers. Such enhancements are formed out of a stock line (the plane of the fin material out of which all fin features are formed). Usually, such enhancements are symmetrical, with reference to any point along the path of air passing over the fin such that enhanced fins include both upstream and downstream enhancements.

Unfortunately, the upstream and downstream lances are often formed at the same angle with respect to the stock line. This results in downstream lances which are in the wake of the upstream lances, inhibiting the effective heat transfer between the downstream lances and the air. Additionally, overlapped louvers have the same problem, that is, heat transfer performance of downstream louvers is adversely affected by upstream louvers.

Thus, there is a need to provide an enhancement which maximizes effective heat transfer of both upstream and downstream lances.

SUMMARY OF THE INVENTION

According to one aspect of the present invention, a heat exchanger coil assembly is provided. The assembly comprises a plurality of fins arranged substantially in parallel with a direction of mean air flow, such that air can flow between adjacent fins, each fin having a plurality of cylindrical sleeves and a corrugated shape comprising at least two corrugations, each corrugation including a first lance and a second lance downstream of the first lance, wherein the first lance is canted at a first angle with respect to the mean air flow direction and the second lance is canted at a second angle with respect to the mean air flow direction, the first angle being different from the second angle such that when air flow passes over the fin, a wake of the first lance will not impinge upon the second lance, and a plurality of heat transfer tubes arranged substantially perpendicular to the plurality of fins, each tube passing through the cylindrical sleeves in the plurality of fins.

According to another aspect of the present Invention, a finned heat exchanger coil assembly is provided, wherein heat transfer takes place between a first fluid flowing through a plurality of spaced-apart finned heat transfer tubes and a second fluid flowing outside of the tubes, Each fin has a corrugated shape with at least two corrugations, each corrugation having a first lance and a second lance downstream of the first lance, wherein the first lance is canted at a first angle with respect to a direction of mean airflow and the second lance is canted at a second angle with respect to the direction of mean airflow, wherein the first angle is different from the second angle such that when air flow passes over the fin, a wake of the first lance will not Impinge upon the second lance.

According to a further aspect of the present invention, a finned heat exchanger coil assembly is provided, wherein heat transfer takes place between a first fluid flowing through a plurality of spaced-apart finned heat transfer tubes and a second fluid flowing outside of the tubes. Each fin comprises at least two corrugations, each corrugation having a first lance on an upstream side of the corrugation and a second lance on a downstream side of the corrugation, wherein the first lance forms an angle of between 5 and 15 degrees with respect to a direction of mean airflow, and wherein the second lance is parallel to the direction of mean airflow, such that a wake of the first lance will not impinge upon the second lance.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

In accordance with the present invention, a heat exchanger coil assembly is provided with fins having a smooth enhancement such as a sinusoid-like (e.g., a shape formed by the intersection of two circular arcs joined at a point of tangency) or a corrugated shape. Preferably, the fin enhancements are corrugated in shape. Each corrugation includes an up-ramp and a down-ramp, wherein each up ramp and each down ramp includes at least one lance, and wherein each lance on a down ramp is positioned such that it is not in the wake of a lance upstream from it. The heat exchanger coil assembly generally comprises a plurality of fins, a plurality of tubes passing through openings in the fins, and end plates located on either side of the plurality of fins.

Figure 1:
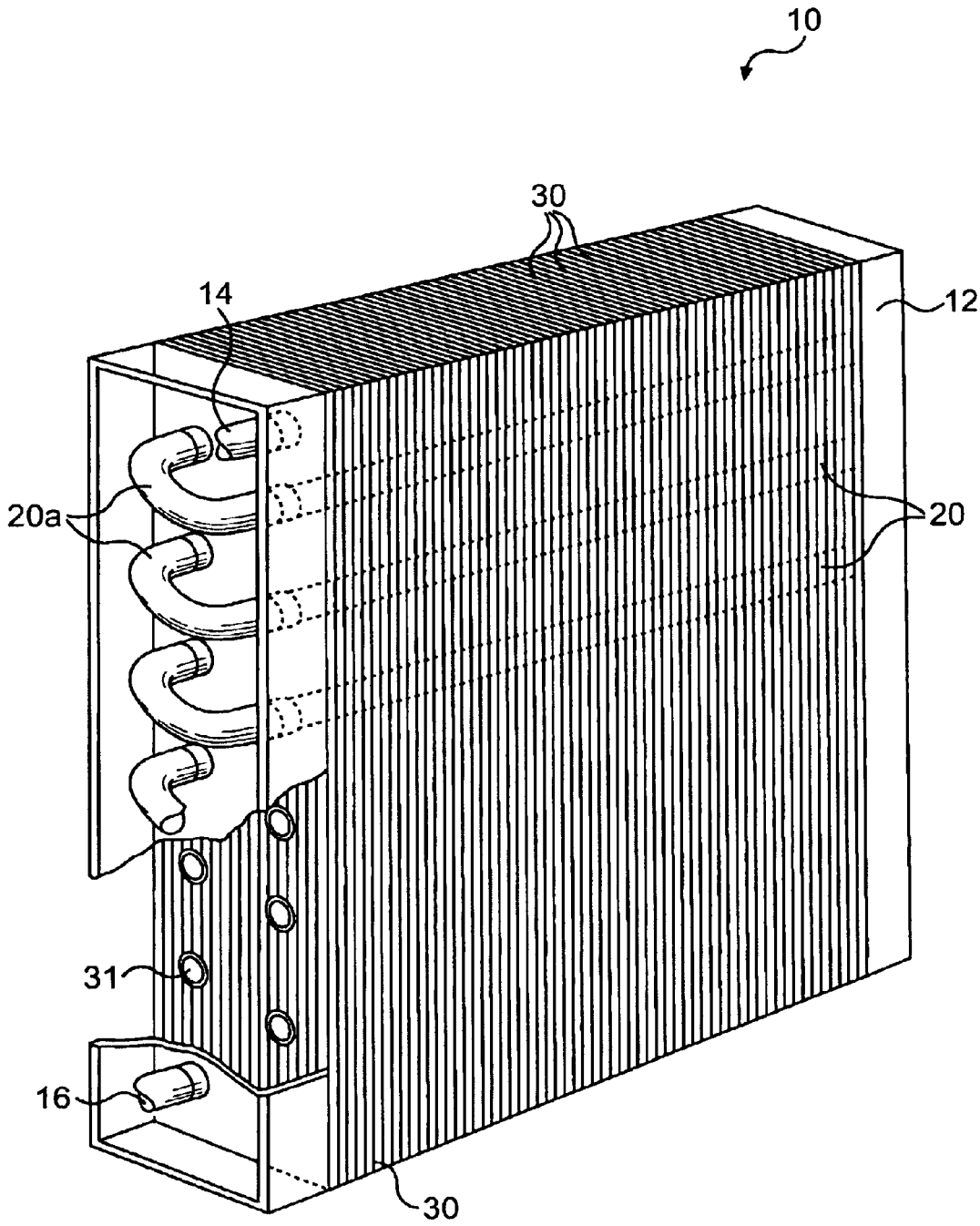
FIG. 1 is a perspective view of a heat exchanger coil assembly according to the present invention.

In accordance with the present invention, the heat exchanger coil assembly includes a plurality of tubes. As embodied herein and shown in FIG. 1, a plurality of tubes 20 is provided in the heat exchanger coil assembly. The hollow tubes 20 extend along the length of the assembly 10 and are connected to one another at their ends by U-shaped bent tube portions 20*a*. The tubes are bundled together and provide a bundle of heat transfer tubes in serpentine form. The tubes 20 are connected to a heat transfer fluid inlet 14 and heat transfer fluid outlet 16, as shown in FIG. 1.

The heat transfer fluid inlet 14 and heat transfer fluid outlet 16 may be located, for example, at the bottom portion of the assembly, or at a side portion of the assembly 10. The number of tubes and their arrangement may vary depending on the requirements of a specific application. The tubes are typically made of copper, however, other suitable materials may also be used. The tubes typically have a round or an oval cross-section, however, other suitable shapes may be used, A first heat transfer fluid flows through tubes 20, and a second heat transfer fluid flows over tubes 20. Tubes 20 provide heat transfer between the first and second heat transfer fluids. Generally, the first heat transfer fluid is water or a refrigerant. However, any suitable heat transfer fluid may be used. The second heat transfer fluid is usually air, which is being warmed or cooled by heat transfer between the first fluid in tubes 20 and fins 30 and the air flowing over tubes 20. Other suitable heat transfer fluids may be used.

In the presently preferred embodiment, 2–12 rows of tubes will be provided to the heat exchanger of the present invention, with preferred embodiments including 6, 8, or 10 rows, and the most preferred embodiment including 6 rows.

In accordance with the present invention, the heat exchanger coil assembly 10 is provided with a plurality of fins 30. The plurality of fins 30 are employed to improve the heat transfer capabilities of the heat exchanger coil assembly. Each fin 30 is a thin metal plate having high thermal conductivity, preferably made of copper or aluminum. Each fin 30 may or may not include a hydrophilic coating. Each fin 30 includes a plurality of cylindrical sleeve openings 31 for receiving the spaced parallel tubes 20, such that the tubes 20 generally pass through the plurality of fins 30 at right angles to the fins 30 as seen in FIG. 1. The fins 30 are preferably arranged in a parallel, closely-spaced relationship along the tubes 20 to form multiple paths for the air or other heat transfer fluid to flow between the fins 30 and across the tubes 20. End plates 12 are located on either side of the arranged fins.

Fins of a single heat exchanger have the same dimensions. Generally, depending upon the intended use of the heat exchanger, the dimensions of the fins may range from less than 1" to 40" in width and up to 48" in height.

Figure 2A:
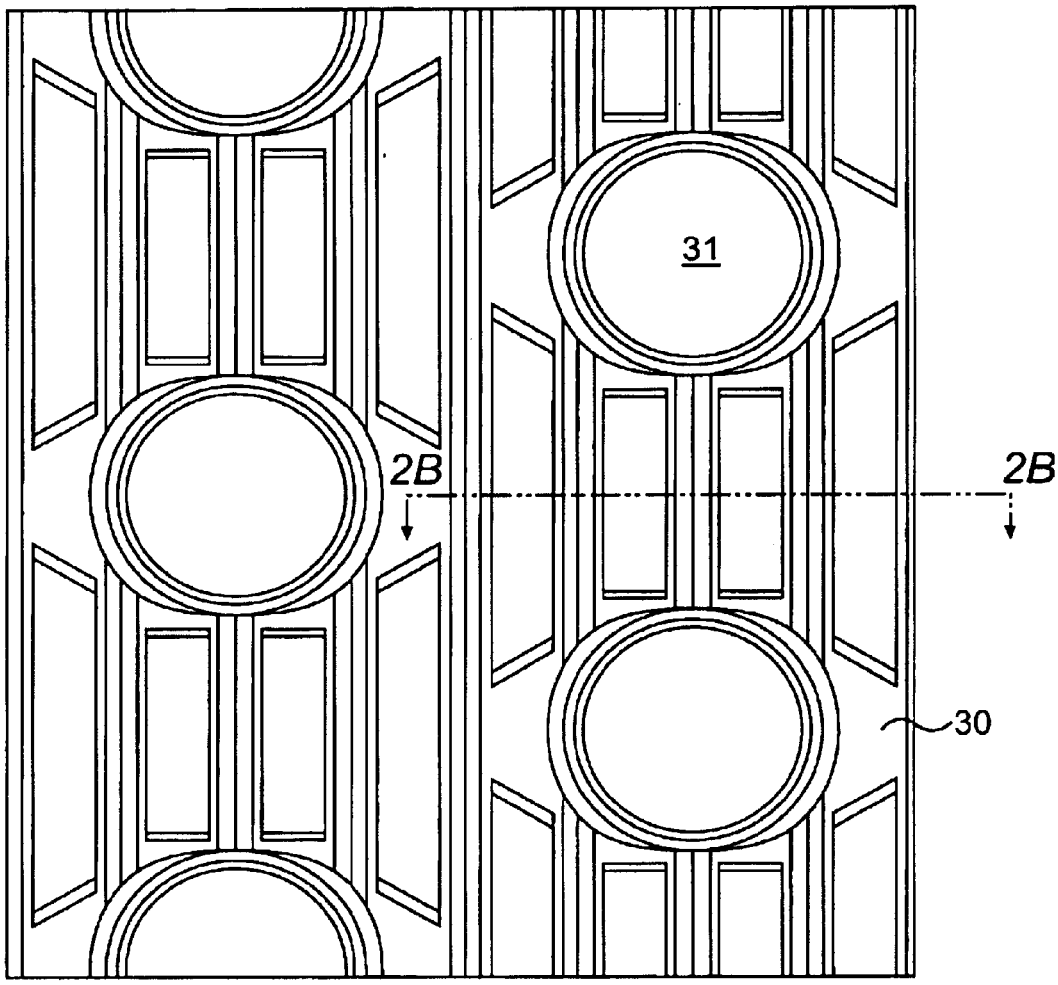
FIG. 2A is a top view of a heat exchanger fin according to the present invention.
Figure 2B:
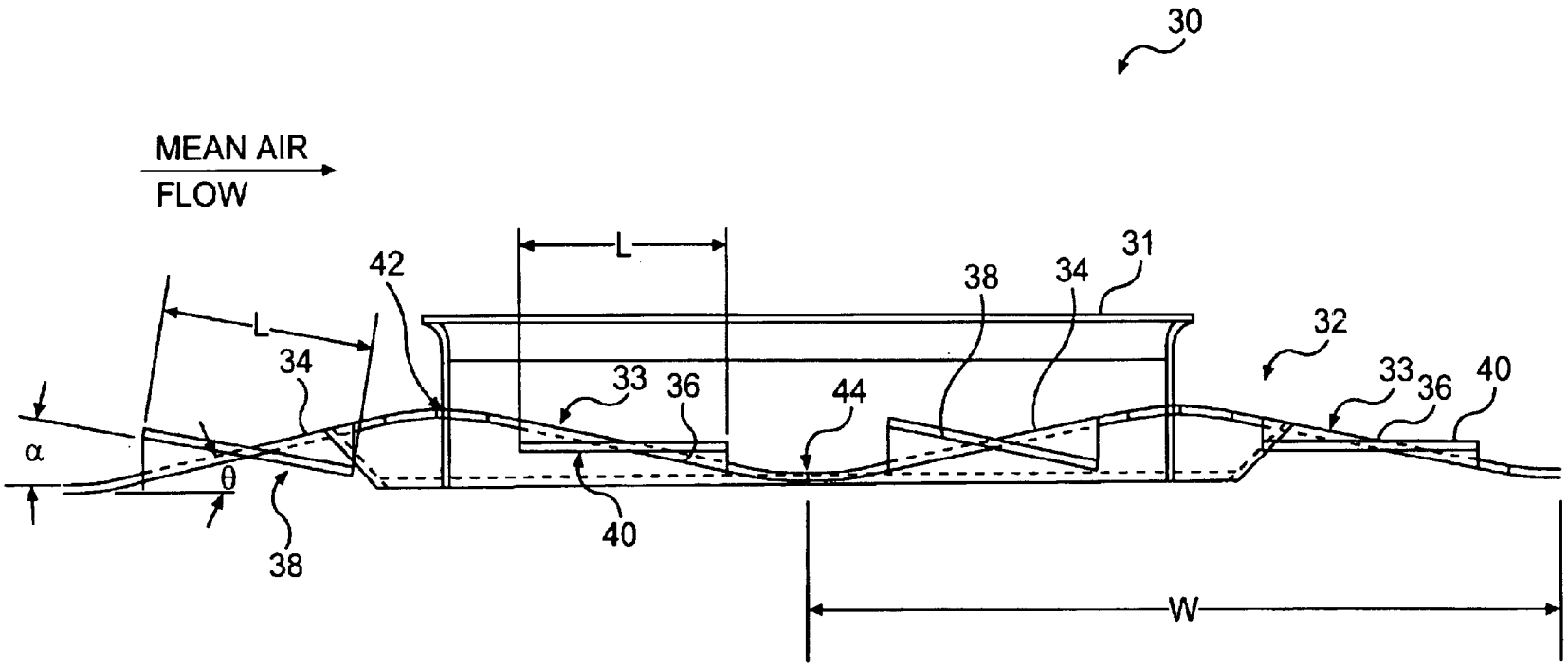
FIG. 2B is a side view of a portion of the heat exchange fin of FIG. 2A taken along line B—B.

Each fin 30 has non-lanced or smooth enhancements designated generally by reference numeral 32. These smooth enhancements 32 are preferably corrugations 33 of fin 30 and, as shown in FIG. 2B, the corrugations 33 may be slightly flattened or slightly rounded at what would be the theoretical apex of the "V" shape. Alternatively, other smooth enhancements such as a sinusoid-like shape may be used. As embodied herein and shown in FIG. 2B, the corrugated shape 32 is extruded from the stock line and forms at least two corrugations 33. Each corrugation 33 is generally in the shape of an inverted, slightly flattened "V" and includes an up-ramp 34 and a down-ramp 36.

Figure 4:
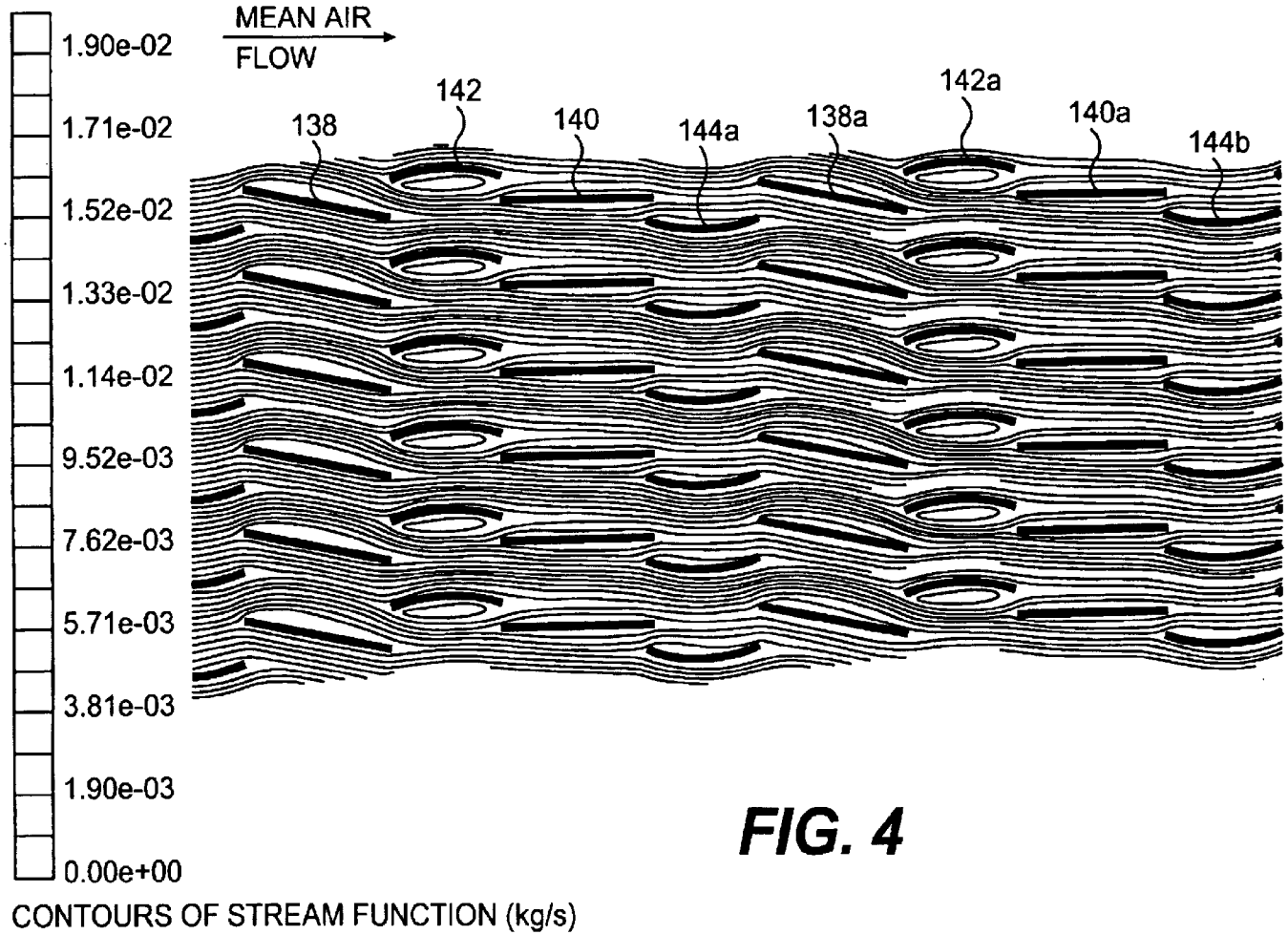
FIG. 4 is a side view of streamlines of air flow moving across a heat exchanger fin (air flow is left to right) according to the present invention.

Each "V"-shaped corrugation has an angle θ formed between an imaginary horizontal line drawn across the widest portion of the inverted "V" and a leg or ramp of the "V," as shown in FIG. 2B. A preferred range for the angle θ is between 5 and 17 degrees, with 17 degrees being the most preferred angle. These corrugations 33 preferably have a width W, from the base of the upward ramp 34 to the base of the downward ramp 36, of approximately one-half inch, as shown in FIG. 2B. Within each corrugation 33, the down-ramp 36 is downstream of the up ramp 34. As used herein, "downstream" is intended to reflect the position of an element with respect to another element relative to the direction of mean air flow. The direction of mean air flow is shown in FIGS. 2B and 4 as moving from left to right.

Each ramp 34, 36 of each corrugation 33 includes a lance. Thus, each up-ramp 34 includes a lance 38 and each down-ramp 36 includes a lance 40. As used herein, "lances" can be differentiated from "louvers" in that louvers are lances that are lined up at the same angle one behind the other, similar to individual louvers of a window shade. Lances need not be lined up as described above, but when they are, they are referred to as louvers. In addition to lances 38 and 40, which are cut out of the corrugated shape 32 of the fin 30, each corrugation 33 also includes a peak and a trough. Both the peak and the trough may act as lances. Thus, although not primarily intended to function as lances, the peak forms a convexly rounded lance 42 and the trough forms a concavely rounded lance 44.

Lances 38, 40 serve to mix temperature-stratified layers of air in the air flow moving across the fin 30 and act as boundary layer restarts. Each time the air flow encounters a lance 38, 40, the stagnate layer of air adjacent to the fin 30 begins to grow thicker, increasing the thermal resistance at the fin surface over the length of the lance thereby increasing the insulating effect at fin surface of that lance. By continuously restarting the boundary layer, the lances enhance the amount of heat transfer between the air and the fin 30 by minimizing the thickness of the boundary layer over the length of the lance. The longer the air flow continues without encountering a lance, the thicker the boundary layer becomes and the less efficient the heat transfer between the fin and the air flow.

It is preferable that the upstream and downstream lances 38, 40 have the same length L, as shown in FIG. 2B. Alternatively, they may have different lengths. The preferred size of the lances is ⅓ of the size of the up-ramp 34 or down ramp 36 of the corrugations 33. However, it is envisioned that lances of different sizes may be utilized, with shorter lances being preferred. Shorter lances and more lances are preferred because they cause the boundary layer to restart more often. Restarting the boundary layer reduces the thermal resistance at the fin surface and increases the overall convective heat transfer of the fin surface.

The lances 38, 40 must be oriented with respect to the air flow over the fin 30 in order to cause the desired mixing of the temperature-stratified air layers. In addition, the lances 38, 40 must be positioned/oriented such that the downstream lance of a given corrugation 33, for example lance 40, is not in the path of the wake of the upstream lance in that particular corrugation, for example lance 38. If the downstream lance, lance 40, is in the wake of the upstream lance, lance 38, the downstream lance cannot act as a boundary layer restart. Therefore, the boundary layer will continue to thicken as the air flow moves over the downstream lance, reducing the effective amount of heat transfer between the air flow and the fin 30. Similarly, between corrugations 33, the downstream lance (the upstream lance of the next corrugation 33*a*) should not be positioned such that it is in the wake of the upstream lance (the downstream lance of the previous corrugation 33 ).

As used herein, the term "wake" refers to the disturbed portion of a bulk flow downstream from a body immersed in the flow. For example, in the present invention, the disturbed portion of a bulk airflow downstream from a lance immersed in the airflow would be termed the wake. Within each corrugation 33, downstream lance 40 is positioned such that it is not in the wake of upstream lance 38. This is achieved by providing the upstream lance 38 and downstream lance 40 at different angles with respect to the corrugated shape 32, such that one lance is canted with respect to the other lance.

By canting one lance with respect to the other, two different streams of air flow are generated such that within each corrugation 33, the downstream lance 40 is not in the wake of the upstream lance 38. Because the downstream lance 40 is not in the wake of the upstream lance 38, the downstream lance 40 can create turbulent flow within the air stream passing over it. That is, the fluid stream (usually air) immediately adjacent to one lance will not be adjacent to the next, downstream lance. Therefore, the leading edge of both the upstream lance 38 and the downstream lance 40 see a velocity profile able to start a new boundary layer (i.e., restart the boundary layer) that will optimize heat transfer for both lances 38, 40.

As embodied herein and shown in FIG. 2B, the upstream lance 38 is canted to prevent the flow adjacent to the upstream lance 38 from impinging on the downstream lance 40. In a preferred embodiment, the downstream lance 40 is horizontal, as shown in FIG. 2B. The upstream lance 38 is canted at an angle $\alpha$ with respect to the mean air flow direction (left to right in FIG. 2B) and the horizontal of the downstream lance 40. The preferred angle a for canting the upstream lance 38 with respect to the mean airflow direction ranges between 5 and 15 degrees, with 11 degrees being the most preferred angle $\alpha$. It is preferred that downstream lance 40 be horizontal to the direction of mean air flow, such that it forms an angle of about 0 degrees with respect to the direction of mean airflow. Alternatively, it is possible that the downstream lance 40 be canted with respect to the upstream lance 38 within the same angular range, i.e. between 5 and 15 degrees. The lances should not, however, be canted at the same angle. By canting one lance with respect to the other, two different streams of air flow are generated such that the downstream lance 40 is not in the wake of the upstream lance 38, thereby maximizing heat transfer for both the upstream and the downstream lances 38, 40.

Figure 3:
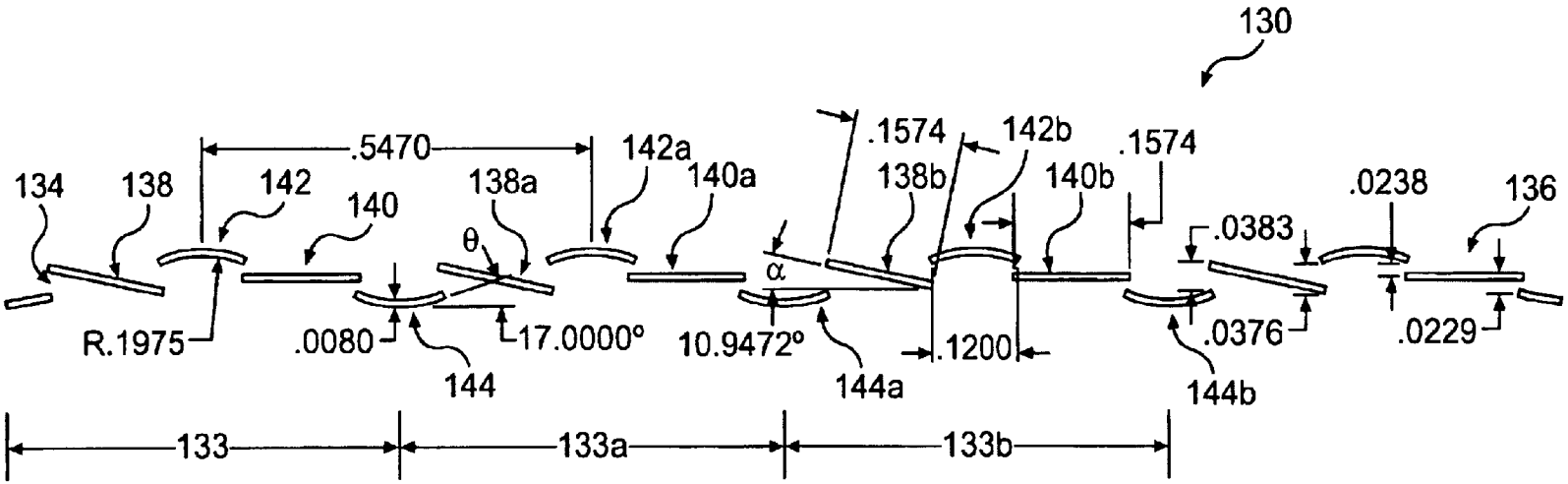
FIG. 3 is a side view of an exemplary heat exchanger fin designed according to the present invention.

An example of a heat exchanger fin 130 designed according to the present invention is shown in FIG. 3. The measurements shown are in inches and are intended to be exemplary only. As shown in FIG. 3, a fin 130 has a corrugated shape comprising a plurality of corrugations. Each corrugation 133 includes a peak and a trough which form a convexly rounded lance 142 and a concavely rounded lance 144, respectively. As shown in FIG. 3, each corrugation 133 includes an up-ramp 134 and a down ramp 136. Each up ramp 134 includes a lance 138 and each down ramp 136 includes a lance 140. Each lance 138 is canted at an angle of approximately 11 degrees with respect to the direction of mean air flow and each lance 140. Each lance 140 is horizontal and parallel to the direction of mean air flow.

Figure 5:
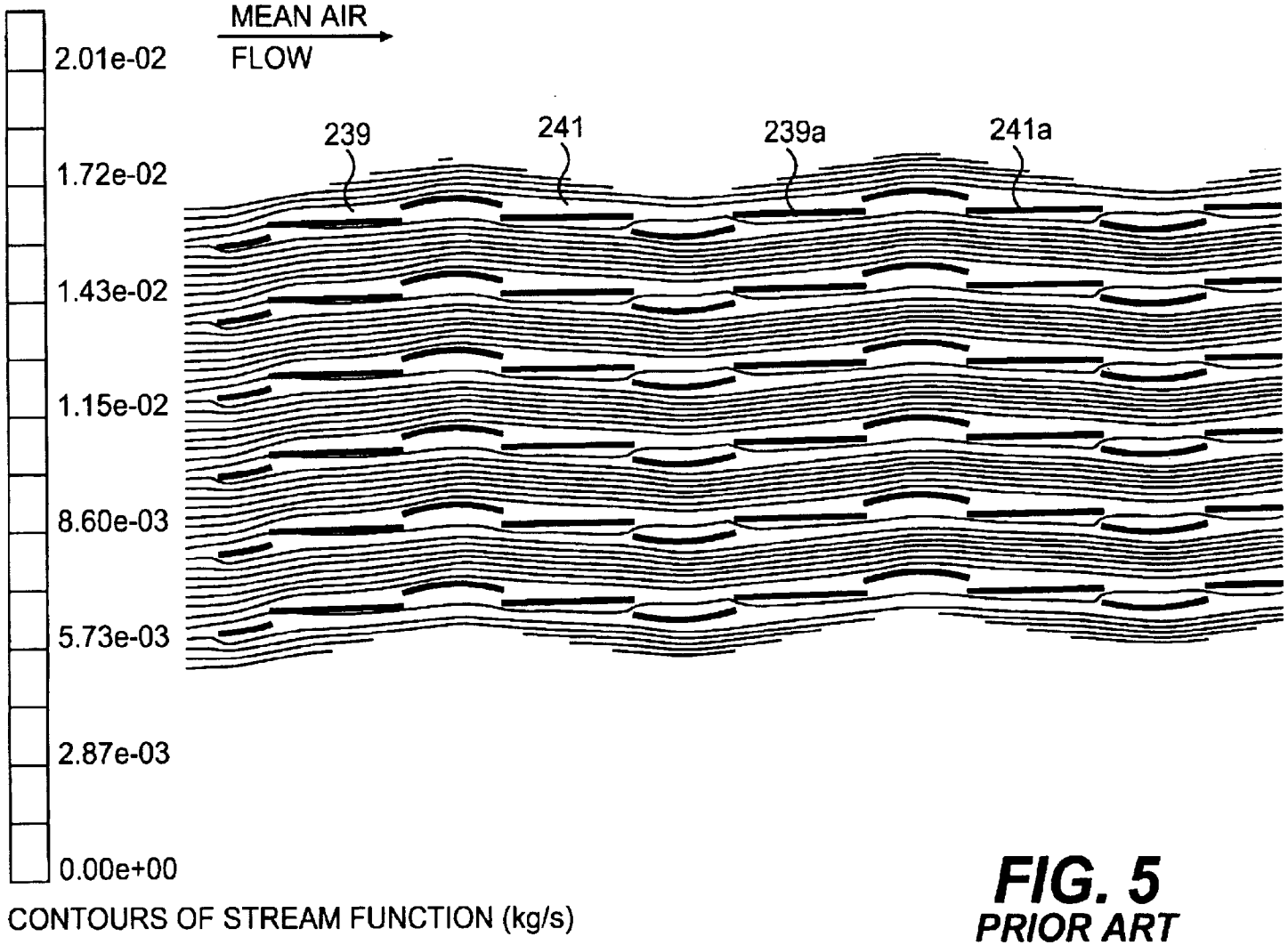
FIG. 5 PRIOR ART
FIG. 5 is a side view of streamlines of air flow moving across a conventional heat exchanger fin.

As shown in FIG. 4, air flow (illustrated as streamlines) passes close to/adjacent to canted lance 138 and is directed downward past, without impinging upon, downstream peak 142 or horizontal lance 140 before impinging upon trough 144*a*. Similarly, air flow which passes adjacent to curved peak 142 passes over horizontal lance 140 and trough 144*a* before impinging on downstream canted lance 138*a* of corrugation 133*a*. Additionally, air is directed past, without impinging upon, trough 144*a* and downstream canted lance 138*a* of corrugation 133*a*. Thus, it can be seen that the flow adjacent to a given lance does not impinge on a lance immediately downstream. In contrast, as shown in FIG. 5, in conventional fins, flow adjacent to a given lance impinges on a lance immediately downstream. For example, flow above a first horizontal lance 239 impinges on the second horizontal lance 241. In addition, flow not immediately adjacent to the lance 239 continues to remain above all downstream lances, preventing mixing of the layers of air and restarting of the boundary layer.

A method of manufacturing a fin having upstream lances and downstream lances is described below. The method includes applying a smooth enhancement to the finstock with a first die, cutting the fin in a direction perpendicular to the mean airflow with a second die, and raising the lances out of the smooth enhancement with the same second die.

As shown in FIG. 2B, the fin 30 includes a smooth enhancement 32. Smooth enhancement 32 is produced by placing the finstock within a first die to form a corrugated shape which is extruded from the stock line. After the corrugated shape is produced, the fin 30 is cut in a direction perpendicular to the mean airflow with a second die. Two cuts are made to produce each lance 38, 40, The lances 38, 40 are formed from the corrugated shape 32 that was extruded from the stock line. Once the fin 30 is cut, the lances 38, 40 are raised out of the corrugated shape 32 of fin 30 by a die. It may be the same die that cut the corrugated shape 32 to form the lances 38, 40. Alternatively, a different die may be used to define the lances 38, 40 within the corrugated shape 32.

Raising the lances 38, 40 out of the corrugated shape 32 of fin 30 includes positioning the downstream lance 40 such that it will not be in the wake of the upstream lance 38. In a preferred embodiment, this includes positioning the downstream lance 40 such that it is horizontal. In addition, the upstream lance 38 is positioned such that it forms an angle of between 5 and 15 degrees with respect to the direction of mean airflow. In a preferred embodiment where downstream lance 40 is horizontal, upstream lance 38 is also positioned such that it forms an angle of between 5 and 15 degrees with respect to downstream lance 40. Preferably, upstream lance 38 is positioned to form an angle of 11 degrees with respect to the direction of mean airflow and horizontal downstream lance 40.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. In a finned heat exchanger coil assembly, wherein heat transfer takes place between a first fluid flowing through a plurality of spaced-apart finned heat transfer tubes and a second fluid flowing outside of the tubes, a fin comprising:

at least two corrugations, each corrugation having a first lance on an upstream side of the corrugation and a second lance on a downstream side of the corrugation, wherein the first lance forms an angle of between 5 and 15 degrees with respect to a direction of mean airflow, and wherein the second lance is parallel to the direction of mean airflow, such that a wake of the first lance will not impinge upon the second lance.

2. A heat exchanger coil assembly, comprising:

a plurality of fins arranged substantially in parallel with a direction of mean air flow, such that air can flow between adjacent fins, each fin having a plurality of cylindrical sleeves and a corrugated shape comprising at least two corrugations, each corrugation including a first lance and a second lance downstream of the first lance, wherein the first lance is canted at a first angle with respect to the mean air flow direction and the second lance is canted at a second angle with respect to the mean air flow direction, the first angle being different from the second angle such that when air flow passes over the fin, a wake of the first lance will not impinge upon the second lance; and a plurality of heat transfer tubes arranged substantially perpendicular to the plurality of fins, each tube passing through the cylindrical sleeves in the plurality of fins.

3. The heat exchanger coil assembly of claim 2, wherein each corrugation includes an up-ramp and a down-ramp.

4. The heat exchanger coil assembly of claim 3, wherein the first lance is on the up-ramp and the second lance is on the down ramp.

5. The heat exchanger coil assembly of claim 2, wherein the first angle ranges between 5 degrees and 15 degrees.

6. The heat exchanger coil assembly of claim 5, wherein the first angle is 11 degrees.

7. The heat exchanger coil assembly of claim 2, wherein the second angle is between 5 degrees and 15 degrees.

8. The heat exchanger coil assembly of claim 2, wherein the second angle is 0 degrees.

9. The heat exchanger coil assembly of claim 2, wherein the second lance is horizontal.

10. The heat exchanger coil assembly of claim 2, wherein the second lance is parallel to a mean airflow direction.

11. The heat exchanger coil assembly of claim 2, wherein each corrugation has a shape of a flattened, inverted "V."

12. The heat exchanger coil assembly of claim 11, wherein an imaginary horizontal line drawn across the widest portion of the "V" and intersecting a leg of the "V" would form an angle θ of between 5 and 17 degrees.

13. The heat exchanger coil assembly of claim 12, wherein the angle θ equals 17 degrees.

14. In a finned heat exchanger coil assembly, wherein heat transfer takes place between a first fluid flowing through a plurality of spaced-apart finned heat transfer tubes and a second fluid flowing outside of the tubes, a fin comprising:

a corrugated shape comprising at least two corrugations, each corrugation having a first lance and a second lance downstream of the first lance, wherein the first lance is canted at a first angle with respect to a direction of mean airflow and the second lance is canted at a second angle with respect to the direction of mean airflow, wherein the first angle is different from the second angle such that when air flow passes over the fin, a wake of the first lance will not impinge upon the second lance.

15. The finned heat exchanger coil assembly of claim 14, wherein first angle ranges between 5 degrees and 15 degrees.

16. The finned heat exchanger coil assembly of claim 15, wherein the first angle is 11 degrees.

17. The finned heat exchanger coil assembly of claim 14, wherein the second angle is between 5 degrees and 15 degrees.

18. The finned heat exchanger coil assembly of claim 14, wherein the second angle is 0 degrees.

19. The finned heat exchanger coil assembly of claim 14, wherein the second lance is horizontal.

20. The finned heat exchanger coil assembly of claim 14, wherein the second lance is parallel to a mean airflow direction.

21. The finned heat exchanger coil assembly of claim 14, wherein each corrugation has a shape of a flattened, inverted "V."

22. The finned heat exchanger coil assembly of claim 21, wherein an imaginary horizontal line drawn across the widest portion of the "V" and intersecting a leg of the "V" would form an angle θ of between 5 and 17 degrees.

23. The finned heat exchanger coil assembly of claim 22, wherein the angle θ equals 17 degrees.

* * * * *